United States Patent [19]

Dudek

[11] 4,196,889

[45] Apr. 8, 1980

[54] HAND-HELD POWERED PORTABLE WINCH

[75] Inventor: Harold M. Dudek, Bellevue, Wash.

[73] Assignee: Astro Development, Seattle, Wash.

[21] Appl. No.: 880,485

[22] Filed: Feb. 23, 1978

[51] Int. Cl.[2] ..... B66D 1/00

[52] U.S. Cl. ..... 254/186 R; 74/750 R

[58] Field of Search ..... 254/186 R, 139.1, 147, 254/168; 74/785, 750 R, 491; 192/4 R; 104/173 R, 173 ST

[56] References Cited

U.S. PATENT DOCUMENTS

| | | | |
|---|---|---|---|
| 1,272,182 | 7/1918 | Appleby | 74/750 R |
| 1,453,559 | 5/1923 | Webb | 254/186 R |
| 2,191,769 | 2/1940 | Morehouse | 254/180 R |
| 2,402,756 | 6/1946 | Lawler | 254/186 R |
| 2,924,430 | 2/1960 | Smith et al. | 254/186 R |
| 3,105,652 | 10/1963 | Becker et al. | 254/168 |
| 3,109,525 | 11/1963 | Welch | 254/186 R |
| 3,291,452 | 12/1966 | Rau et al. | 254/186 R |

*Primary Examiner*—Kenneth W. Noland

*Attorney, Agent, or Firm*—Seed, Berry, Vernon & Baynham

[57] ABSTRACT

A hand-held, powered, portable winch is provided with a unique planetary gear reduction unit that couples the motor to a winch drum. Controls are provided in a carrying handle for energizing a clutch to actuate rotation of the drum while simultaneously controlling the speed of the motor. The gear reduction unit is uniquely stabilized against racking loads on the gears and against radial loads imposed by the clutch. The winch is uniquely used in a method for hoisting by attaching the winch to the load with the hoisting line attached remotely to a fixed object. In this manner the load and the winch are drawn to the fixed object.

7 Claims, 6 Drawing Figures

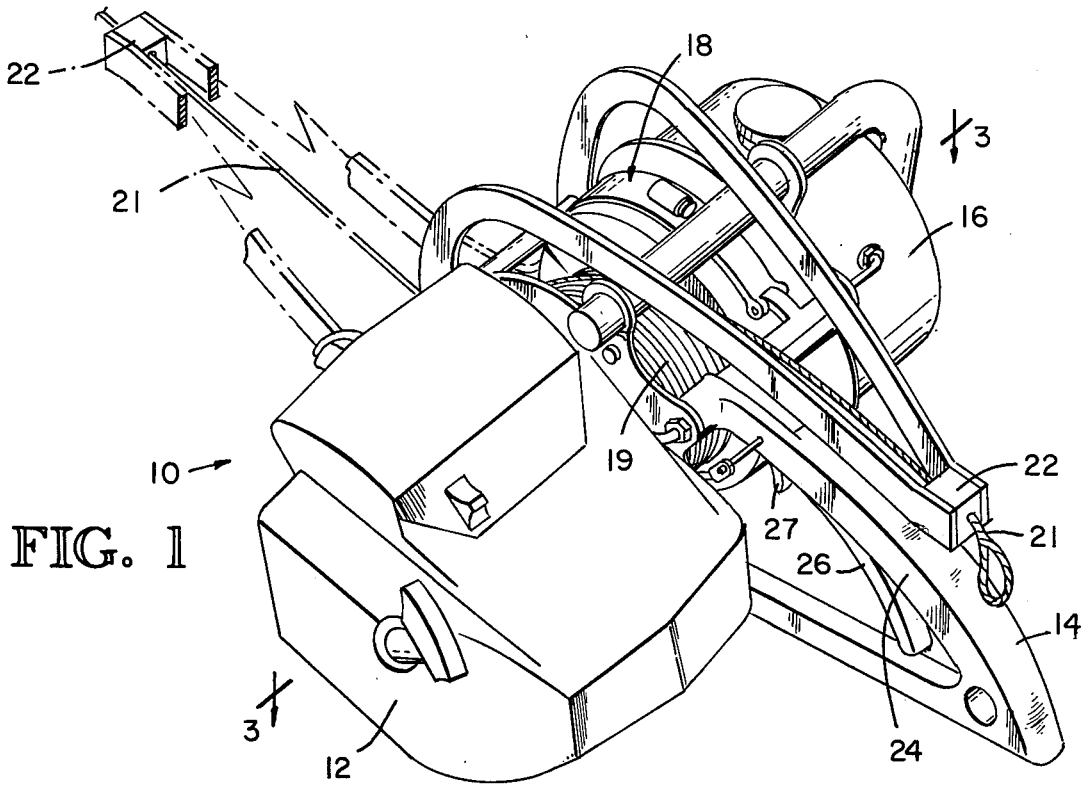
FIG. 1
FIG. 2
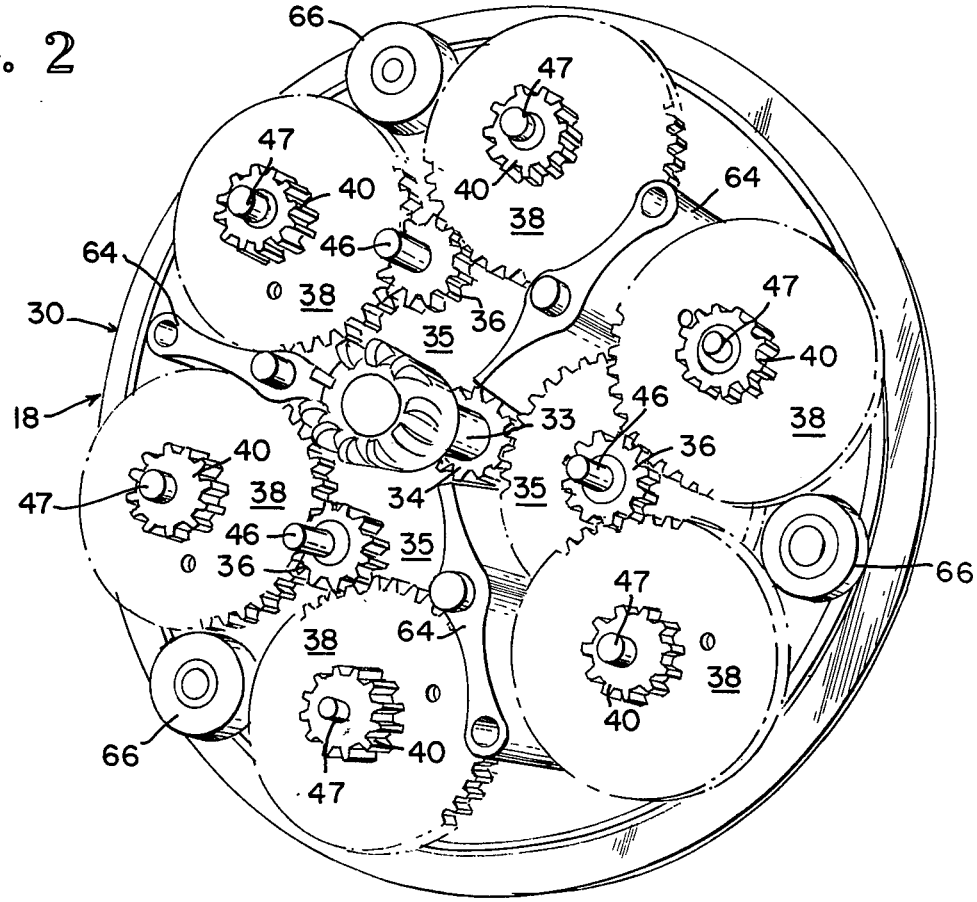

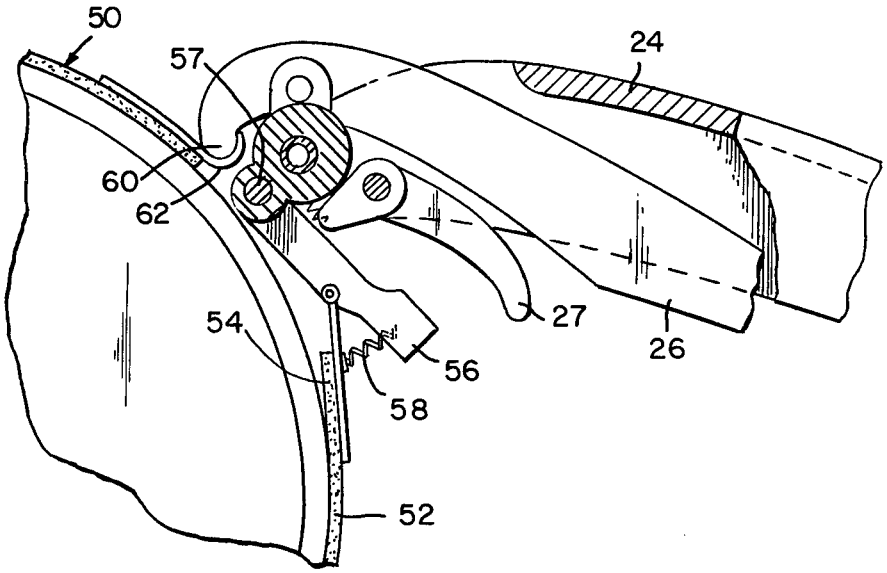
FIG. 5
FIG. 6
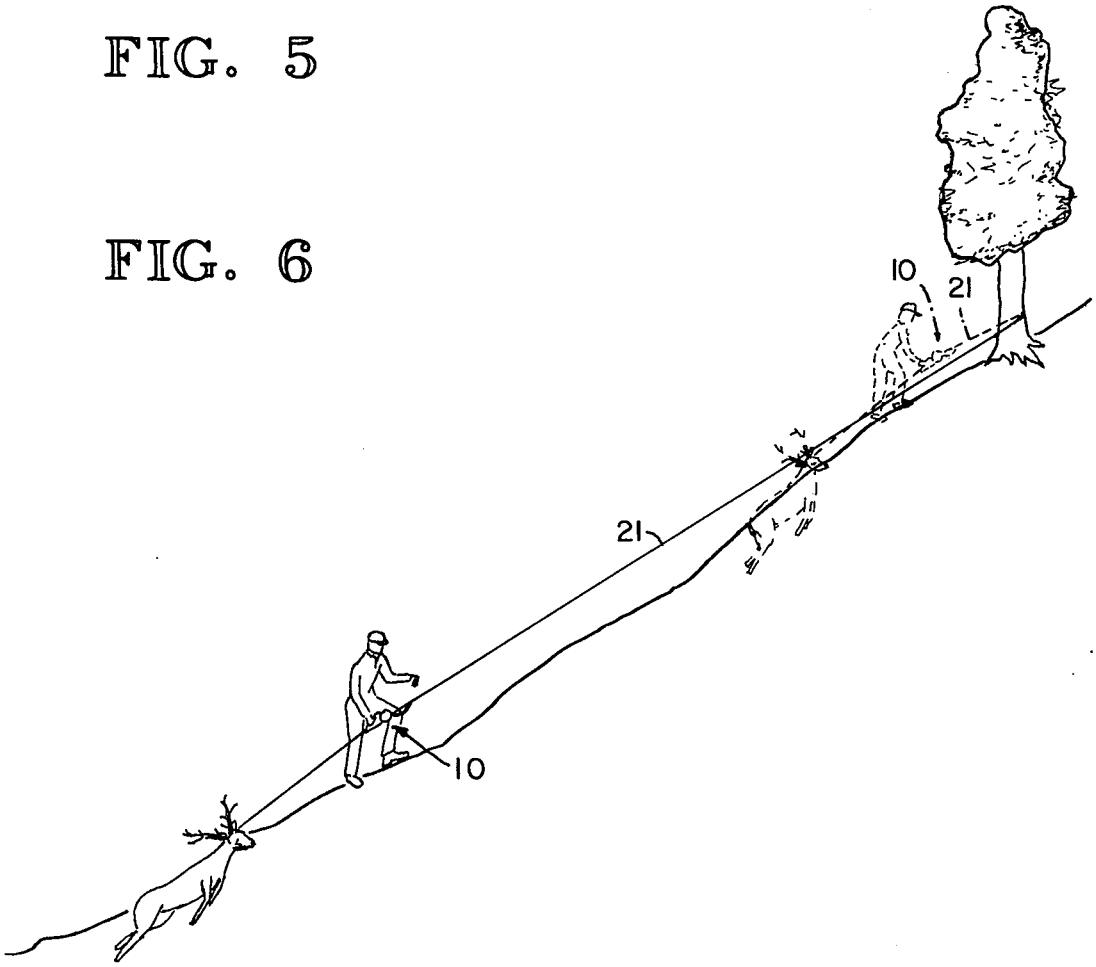

HAND-HELD POWERED PORTABLE WINCH

FIELD OF THE INVENTION

This invention pertains to hoisting devices and methods of hoisting. More particularly the invention is directed to hand-held, powered, portable winching devices and methods of using such.

SUMMARY OF THE INVENTION

It is an object of this invention to provide a handheld, powered, portable winch for use in hoisting in difficult terrain.

It is another object of this invention to provide a low-cost, highly durable gear reduction unit for small, portable, powered winches.

It is another object of this invention to provide a method of hoisting loads using a hand-held, powered, portable winch.

BRIEF DESCRIPTION OF THE FIGURES OF THE DRAWING

FIG. 1 is a perspective illustration of a winch embodying the principle of the invention.

FIG. 2 is a fragmentary isometric of a gear reduction unit employed in the winch of FIG. 1.

FIG. 5 is a fragmentary detail of a portion of the winch shown in FIG. 1.

FIG. 6 is a schematic illustration of a hoisting technique embodying the principles of the invention.

DETAILED DESCRIPTION OF THE PREFERRED EMBODIMENTS

Figure 3:
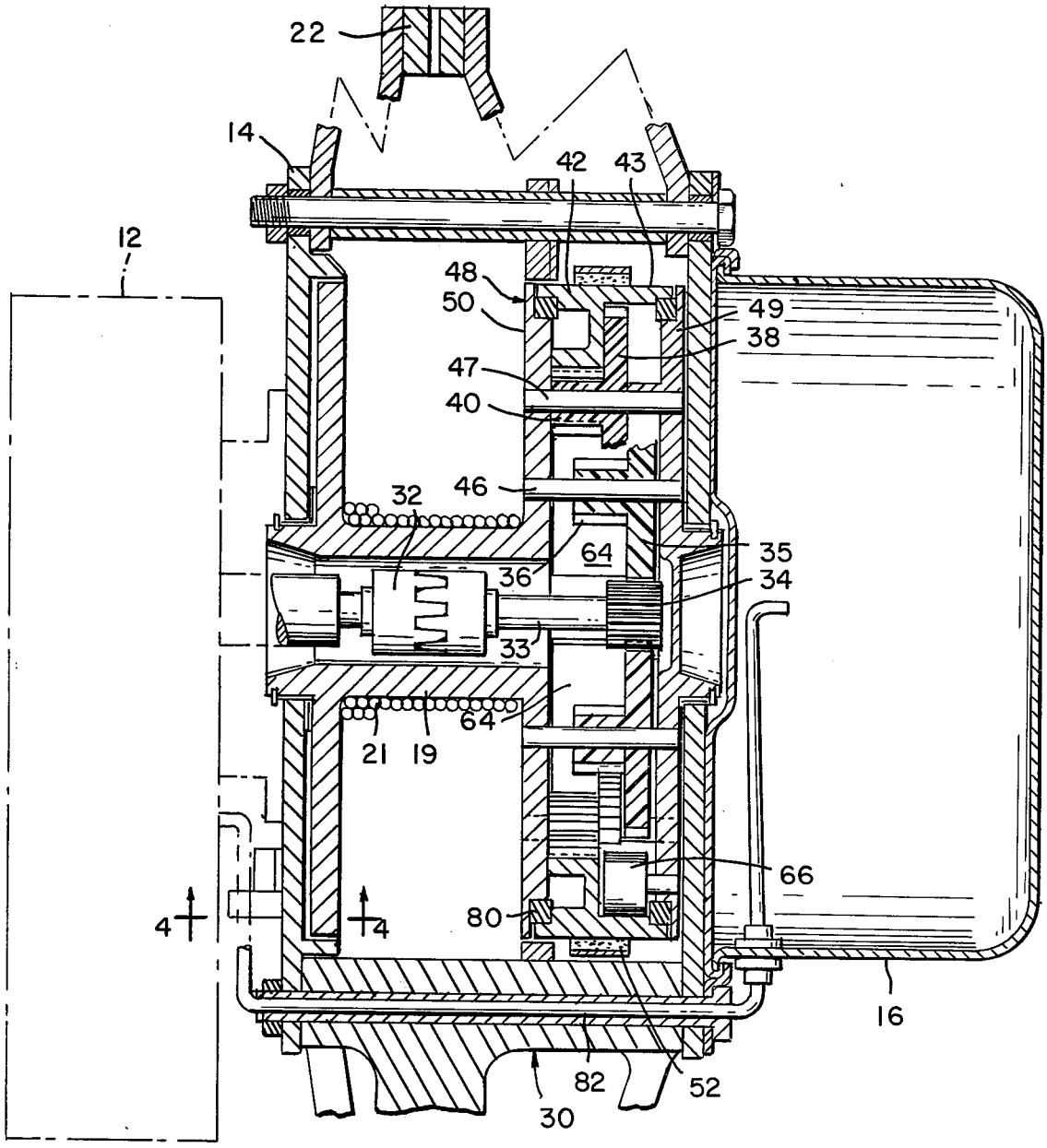
FIG. 3 is a diametrical section of the gear reduction unit shown in FIG. 2.

As best shown in FIG. 1, a winch 10 is provided with an engine or motor 12, a main frame 14, a gas tank 16, a winch assembly 18 having a drum 19 and a hoisting line 21. Preferably the hoisting line 21 travels out through a pivotal fairlead 22 which can be swung to the position shown in FIG. 1 for guiding the cable into the underside of the winch drum 19. The engine 12 may be electrically powered, but preferably is gasoline powered since it is contemplated that the winch will be employed in those areas where electricity is not available.

The winch is provided with a carrying handle 24 which is uniquely provided with a clutch control level 26 and a throttle trigger 27 in a manner to be described. In use, the winch is preferably used in the method illustrated in FIG. 6. The winch 10 is suitably attached to the load, an animal shown in FIG. 6, with the hoist line 21 first attached to a fixed object at the location to which the load is to be moved. In the preferred embodiment, the hoist line 21 is first fixed to a tree, for example, and the winch 10 carried down the hill to the load with the line free-wheeling off the drum. After the winch is attached to the load, the engine is started and the operator carries the winch while simultaneously controlling the speed of the motor and the clutching of the gear reduction unit so that both the winch and the load and the object are "walked or pulled" up the hill to the fixed object. In this manner the operator has full control of the load and can watch closely its progress as it is being hoisted so that the winching can be halted if an obstruction is encountered without overloading the line or damaging the load.

The winch assembly 18, as best shown in FIGS. 2 and 3, includes a 100:1 or other suitable gear reduction unit 30. Obviously other gear reduction ratios can be employed but it is important to get as large a reduction as is possible because of the limited capacity of portable engines. The engine 12 is provided with a drive coupling 32 that meshes with a shaft 33. A sun gear 34 is keyed to the shaft 33. The sun gear meshes with a plurality of primary planetary gears 35 each having an integral smaller stepped gear 36. The stepped gears 36 mesh with secondary planetary gears 38, each of which are provided with a smaller stepped gear 40. Several stepped gears 40 such as the 6 illustrated in FIGS. 2 and 3, are preferably used to distribute the loading over more than the normal three planetary gear arrangements so that less expensive plastic gears can be employed. The stepped gears 40 in turn mesh with an internal ring gear 42 having a smooth outer surface 43.

As is well understood with planetary gears, all of the gears are provided with axles 46 and 47 which are carried in a planetary carrier 48 having an outside plate 49 and an inside plate 50 which forms a part of the drum 19. As is well understood when the ring gear 42 is stopped, the planetary carrier 48 rotates, thus rotating the drum 19.

Clutching means are provided for stopping the ring gear 42. As best shown in FIG. 5 the clutching means 50 includes a friction band 52 having an anchored end 54 that is connected to a pivotal anchor member 56. The pivotal end of the anchor member is pivoted at 57 to the carrying handle 24 of the main frame 14. A spring 58 pushes the anchor member 56 away from the friction band 52 to keep the anchored end 54 from going over center relative to the pivot 57 and staying in that position after the friction band 52 is released. To set the brake and thus "clutch" the gear reduction unit into motion, the lever 26 is provided with a hooked end 60 that engages the free end 62 of the friction band. Thus to stop the internal ring gear 42 the lever 26 is pulled toward the handle 24 pulling the free end of the friction band toward the anchored end thus tightening the band on the smooth surface of the ring gear 43. When the clutch is released, the ring gear is free to rotate so that no power is applied to the drum.

In order to prevent loads imposed by the pull of the cable on the drum from racking the gears a plurality of stationary spacer members 64 (FIG. 3) support the side plates 49 and 50. Also to prevent excessive radial loads caused by the forces applied by the friction band 50 a plurality of roller bearings 66 are spaced around the internal ring gear 42 to support the radial loads imposed by the ring gear 42.

Figure 4:
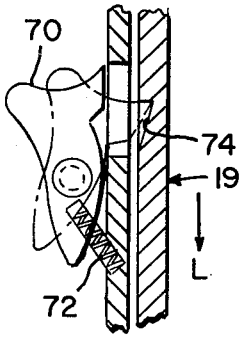
FIG. 4 is a fragmentary section taken along the line 4—4 of FIG. 3.

In some instances it will be desirable to release the clutch and/or stop the motor while still holding the load against pulling of the winch back down the hill. In this case is a releasable detent 70 as illustrated in FIG. 4 is held by a spring 72 into engagement with a notch 74 on the winch drum 19. With the line being hoisted in, the ratchet merely slips by the notches 74 but if the drum tries to rotate by pull of the load in the opposite direction the detent 70 will seat in the notch 74 preventing movement of the drum.

The entire cavity between the side plates 49 and 50 is provided with a heavy oil or gear lubricant and is sealed by seals 80. Gasoline to the motor 12 is carried from the tank 16 by a conduit 82.

As is thus readily apparent, the winch is quite compact and yet retains a high gear reduction ratio for allowing a small conventional 1½ horse power engine, for example, to hoist large loads. While modifications will be apparent to one skilled in the art without departing from the principles herein it is thus to be understood that the invention is not to be limited to the specific embodiments illustrated in the drawing.

I claim:

1. A hand-held, powered, portable winch having an engine with a speed control, a carrying handle, a main frame, a winch assembly having a gear reduction unit driven by the motor and a winch drum, a line on the winch drum having a free end adapted to be coupled to an object remote from the drum, and means for controlling the rotation of the winch drum and motor, said gear reduction unit comprising a sun gear, a set of primary planetary gears having gear axles and meshed with said sun gear, a set of secondary planetary gears having gear axles and meshed with the primary planetary gears, a planetary carrier coupled to said gear axles and to said drum for driving said drum, a ring gear meshed with said secondary planetary gears, clutch means for holding said ring gear for rotating said planetary carrier at a greatly reduced gear reduction when said ring gear is held wherein release of the clutch allows the drum to free-wheel but engagement of the clutch rotates the drum to pull in the line, said primary planetary gears each including a large step gear and an integral small step gear, said secondary planetary gears each including pairs of large step gears and integral small step gears, said sun gear meshing with all said primary large step gears, said primary small step gears meshing with adjacent pairs of said secondary large step gears, said primary small step gears meshing with said ring gear.

2. The winch of claim 1, said clutch including a friction band wrapped around the ring gear, means anchoring one end of the band, manual clutch control means on the handle for moving the opposite unanchored end of the band toward the anchored end for locking the ring gear and applying a radial side load on said ring gear, said gear reduction unit including a plurality of bearing assemblies spaced around said ring gear for supporting the ring gear against said radial loading.

3. The winch of claim 1, said planetary carrier including a first side plate integral with said winch drum and a second side plate, a plurality of equidistantly spaced spacer members separating said side plates to prevent racking loads on said planetary gears.

4. The winch of claim 1, including a releasable ratchet mechanism for selectively locking the drum against rotation in the direction of haul out when the friction band is released.

5. A hand-held, powered, portable winch having an engine with a speed control, a carrying handle, a main frame, a winch assembly having a gear reduction unit driven by the motor and a winch drum, a line on the winch drum having a free end adapted to be coupled to an object remote from the drum, and means for controlling the rotation of the winch drum and motor, said gear reduction unit comprising a sun gear, a set of primary planetary gears having gear axles and meshed with said sun gear, a set of secondary planetary gears having gear axles and meshed with the primary planetary gears, a planetary carrier coupled to said gear axles and to said drum for driving said drum, a ring gear meshed with said secondary planetary gears, clutch means for holding said ring gear for rotating said planetary carrier at a greatly reduced gear reduction when said ring gear is held wherein release of the clutch allows the drum to free-wheel but engagement of the clutch rotates the drum to pull in the line, said carrying handle including a first lever for actuating said clutch and a second lever for actuating said engine speed control, said engine speed control fitted within said clutch actuating lever for providing clutch and speed control with one hand.

6. A hand-held, powered, portable winch having an engine with a speed control, a carrying handle, a main frame, a winch assembly having a gear reduction unit driven by the motor and a winch drum, a line on the winch drum having a free end adapted to be coupled to an object remote from the drum, and means for controlling the rotation of the winch drum and motor, said gear reduction unit comprising a sun gear, a set of primary planetary gears having gear axles and meshed with said sun gear, a set of secondary planetary gears having gear axles and meshed with the primary planetary gears, a planetary carrier coupled to said gear axles and to said drum for driving said drum, a ring gear meshed with said secondary planetary gears, clutch means for holding said ring gear for rotating said planetary carrier at a greatly reduced gear reduction when said ring gear is held whereby release of the clutch allows the drum to free-wheel but engagement of the clutch rotates the drum to pull in the line, said clutch including a friction band wrapped around the ring gear, means anchoring one end of the band, manual clutch control means on the handle for moving the opposite unanchored end of the band toward the anchored end for locking the ring gear and applying a radial side load on said ring gear, said gear reduction unit including a plurality of bearing assemblies spaced around said ring gear for supporting the ring gear against said radial loading, said friction band anchored end including a movable anchoring lever, said anchoring lever pivotally mounted at one end to said main frame and connected to said friction band at its movable end, and spring means for pushing said movable end of said anchoring lever away from the ring gear to provide free release of the friction band when said movable opposite end of the friction band is moved away from the anchored end to reduce grabbing due to the self-energizing characteristics of the band.

7. A hand-held, powered, portable winch having an engine with a speed control, a carrying handle, a main frame, a winch assembly having a gear reduction unit driven by the motor and a winch drum, a line on the winch drum having a free end adapted to be coupled to an object remote from the drum, and means for controlling the rotation of the winch drum and motor, said gear reduction unit comprising a sun gear, a set of primary planetary gears having gear axles and meshed with said sun gear, a set of secondary planetary gears having gear axles and meshed with the primary planetary gears, a planetary carrier coupled to said gear axles and to said drum for driving said drum, a ring gear meshed with said secondary planetary gears, clutch means for holding said ring gear for rotating said planetary carrier at a greatly reduced gear reduction when said ring gear is held whereas release of the clutch allows the drum to free-wheel but engagement of the clutch rotates the drum to pull in the line, said clutch including a friction band wrapped around the ring gear, means anchoring one end of the band, manual clutch control means on the handle for moving the opposite unanchored end of the band toward the anchored end for locking the ring gear and applying a radial side load on said ring gear, said gear reduction unit including a plurality of bearing assemblies spaced around said ring gear for supporting the ring gear against said radial loading, further including a large step gear and an integral small step gear, said secondary planetary gears each including pairs of large step gears and integral small step gears, said sun gear meshing with all said primary large step gears, said primary small step gears meshing with adjacent pairs of said secondary large step gears, said primary small step gears meshing with said ring gear.

* * * * *